United States Patent [19]

Murray

[11] Patent Number: 4,915,058

[45] Date of Patent: Apr. 10, 1990

[54] WINDOW MASK WITH RELEASABLE SECURING MEANS

[76] Inventor: Douglas A. Murray, 425 N. Pershing, Wichita, Kans. 67208

[21] Appl. No.: 274,457

[22] Filed: Nov. 21, 1988

[51] Int. Cl.[4] ..... B05C 1/05; B05C 21/00

[52] U.S. Cl. ..... 118/505

[58] Field of Search ..... 118/505

[56] References Cited

U.S. PATENT DOCUMENTS

| | | | |
|---|---|---|---|
| 1,605,670 | 11/1926 | Lee | 118/505 |
| 2,210,233 | 8/1940 | Lillo | 118/505 |
| 2,286,473 | 6/1942 | Duggan | 118/505 |
| 2,341,702 | 2/1944 | Duggan | 118/505 |
| 2,371,859 | 3/1945 | Wallace | 118/505 |
| 2,646,118 | 7/1953 | Berty | 160/370.2 |
| 2,840,039 | 6/1958 | Darnell et al. | 118/505 |
| 3,184,264 | 5/1965 | Ealey et al. | 160/370.2 |
| 3,338,293 | 8/1967 | Hohman | 160/370.2 |
| 4,361,643 | 11/1982 | Banks et al. | 118/505 |
| 4,406,246 | 9/1983 | Demeyer | 118/505 |

FOREIGN PATENT DOCUMENTS 2201908 9/1988 United Kingdom ..... 118/505

OTHER PUBLICATIONS

References marked "X" were cited in specification by Applicant, and are cited here as of interest.

*Primary Examiner*—Willard Hoag

*Attorney, Agent, or Firm*—Robert E. Breidenthal

[57] ABSTRACT

A semi-rigid mask spatially contoured and sized to overlie and be generally conformable to a vehicular window while lying in the closely spaced peripheral relation to vehicular trim bordering the window. The mask is provided with a pair of spaced suction cup structures operable by external handles to engage and release the window. The mask is peripherally thickened to reinforce shape retentivity by the mask and to provide an elevated surface for the application of masking tape to the mask and the ornamental boundary trim.

9 Claims, 2 Drawing Sheets

WINDOW MASK WITH RELEASABLE SECURING MEANS

BACKGROUND OF THE INVENTION

1. Field of the Invention

The present invention relates to new and useful improvements in painting aids or accessories, and more particularly pertains to a manually manipulatable semi-rigid mask adapted for releasable adherence to a vehicular window in an arrangement such that masking tape can be applied readily to overlap the mask and ornamental trim bounding the vehicular window, whereby spray painting can be effected without exposure of the window and the trim to paint.

2. Description of Related Art

Numerous proposals have heretofore been made pertaining to masks for excluding paint from various surfaces during the spray painting of adjacent areas. Indeed such proposals have suggested the use of suction cups or grooves to releasely secure the masks during use. Proposals of somewhat analogous nature have been made involving the use of shields for windshields during snowy or icy weather wherein suction cups are employed for releasably attachment.

A review of several U.S. Patents affords an appreciation of the background of the present invention.

U.S. Pat. No. 4,406,246 which issued to DeMeyer et al, Sept. 27, 1983, proposes a protective housing having side walls having an extremity that is contoured to seat about window molding, with suction cups being provided to releasably secure the protective shield.

U.S. Pat. Nos. 2,286,473 and 2,341,702 which issued to J. E. Duggan respectively on June 16, 1942, and Feb. 15, 1944, and U.S. Pat. No. 2,371,859 which issued to Wallace on Mar. 20, 1945, all disclose shields or masks for use during painting, wherein various forms of suction devices are used to secure such devices to automotive bodies.

U.S. Pat. Nos. 2,646,118, 3,184,264 and 3,338,293 which issued to Berty, Ealey et al and Hohmann respectively on Jul. 21, 1953, May 18, 1965, and Aug. 29, 1967, disclose various forms of windshield protectors (for snow and the like) wherein the protectors are secured by suction cups.

Means other than suction devices have been proposed for attachment of shields, masks and the like. For example, U.S. Pat. No. 2,840,039 which issued to Darnell et al on June 24, 1958, suggests the use of magnets; U.S. Pat. No. 2,210,233 which issued to Lillo on Aug. 6, 1940, employs an adhesive; and U.S. Pat. No. 1,605,670 which issued to Lee on Nov. 2, 1926, effects a mechanical interlock with structure bounding the window.

SUMMARY OF THE INVENTION

Broadly the present invention involves a spray painting accessory for preventing paint from contacting a vehicular window and trim peripherally bounding the latter, said accessory comprising a mask plate of substantial spatial configuration integrity that is adapted to overlie an outer exposed vehicular window surface in a nearly coextensive fashion, said mask plate having inner and outer sides with controllable suction cup means adapted for releasable attachment to a window being carried by and extending through the mask plate, said suction cup means including a suction cup on the inner side of the plate and a manually operable suction cup control handle on the outside of the plate, the arrangement being such that a user can grasp the handle to support the mask plate while orienting the latter for use with respect to a vehicular window, and then manually operate the handle to actuate the suction cup for suction engagement with a window, and said mask plate being provided with an integral upstanding peripheral margin portion serving to contribute to the spatial integrity of the mask and defining an elevated surface for masking tape application.

More specifically, the present invention involves a mask for use in combination with a vehicular window bounded by ornamental trim, wherein such window has an outer exposed surface of a particular contour and peripheral configuration, with the bounding trim having an exposed surface that is elevated along its bounding extent relative to adjacent peripheral portions of the exposed window surface, said mask comprising a mask plate of substantially the same contour and has peripheral dimensions less than the exposed window surface, said mask plate having inner and outer sides with a spaced pair of controllable suction cup means secured thereto extending therethrough, each of said suction cup means including a suction cup on the inner side of the mask plate and a manually operable suction cup control and support handle disposed on the outer side of the mask plate with said handle being operatively connected to the suction cup to actuate and release suction action of the suction cup, the arrangement being such that the mask plate can be secured in close proximity to the exposed window surface by suction adherence of the suction cups to the window with the periphery of the plate being closely spaced within the trim, said mask plate being provided about its periphery with an integral upstanding marginal portion for facilitating by reinforcement spatial shape retention by the mask and for also providing an elevated surface for the application of masking tape to the mask and the trim.

BRIEF DESCRIPTION OF THE DRAWINGS

The invention, its practice and its advantages will be most readily understood upon considering a description of a preferred and exemplary embodiment thereof, with such description being given in conjunction with the accompanying drawings illustrative thereof wherein.

DESCRIPTION OF THE PREFERRED EMBODIMENT

Figure 1:
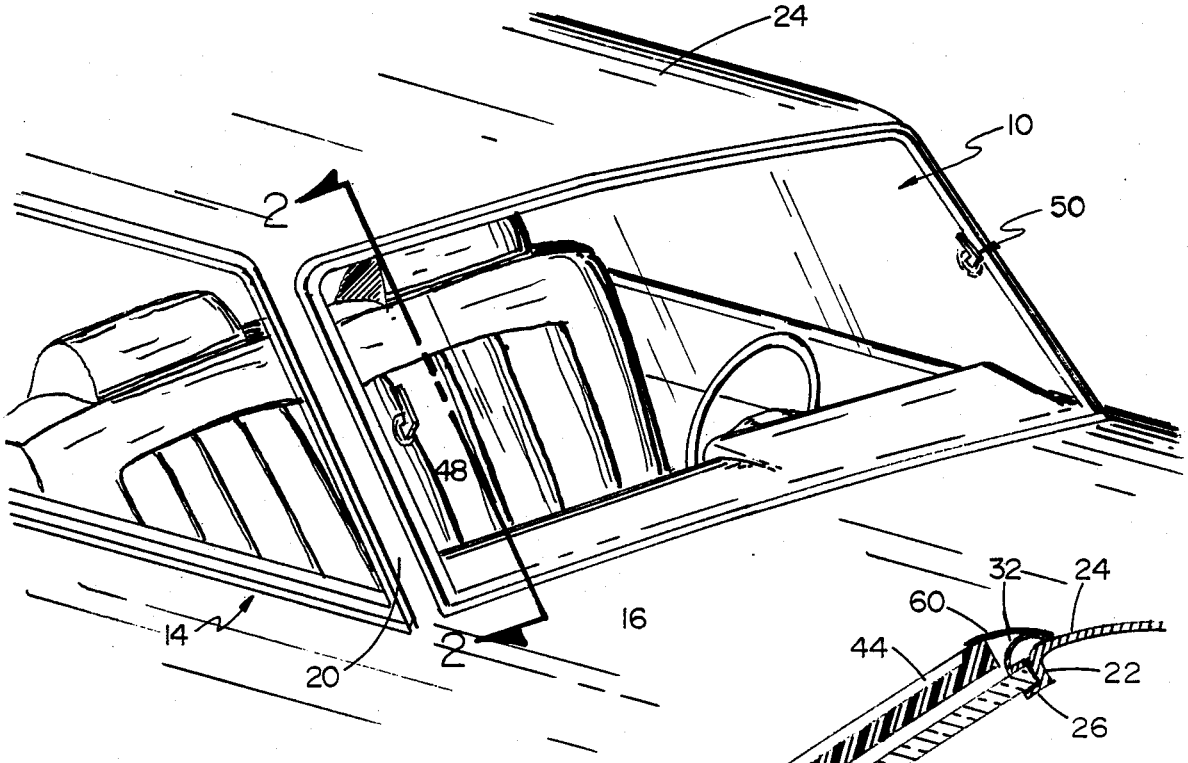
FIG. 1 is an isometric view of the mask of this invention showing the same in position for use in painting about the windshield of a fragmentary depiction of a passenger automobile.

Referring now to the drawings wherein like numerals designate like parts throughout the various views the reference numeral 10 designates generally the mask of this invention. The specific disclosed embodiment of the mask 10 is sized and has a shape conformable to the particular spatial configuration of the windshield 12 of a conventional passenger automobile shown generally at 14. The automobile 14 conventionally includes a trailing hood portion 16 that is provided with an integral upstanding windshield seat 18 which in conjunction with the hood 16 and the adjacent sides of adjoining posts 20 and the forward edge portion 22 of the passenger compartment roof 24 define a peripheral frame 26 for the windshield 12. The windshield 12 is conventionally secured to the frame 26 with conventional or suitable water sealing means such as partially shown at 29 and 30.

Also, as is customary for primarily ornamental purposes, the windshield 12 is peripherally bordered by a length of ornamental trim 32, which may typically be of chrome-plated steel, or of plastic provided with a reflective metalized surface. As shown, the trim 26 is conventionally secured to overlap the juncture of the windshield 12 and the encompassing frame 26.

The external surfaces of the hood 16, the posts 20 and the roof 22 that are exposed to view outside the trim 32 are conventionally painted with enamel or lacquer, whatever the underlying base material may be (such as steel, aluminum, a fiberized resin, etc.). During the course of time, paint deterioration, repair of hail or accident damage, or merely a desire to change automobile color requires that such exposed surfaces be repainted.

Such painting, whether by hand or spraying, is a difficult task and requires great skill if the surfaces to be painted are uniformly coated while the windshield 12 and the trim 32 are to be kept free of any contact by paint.

Avoidance of paint contacting windows, such as the windshield 12 is conventionally effected by professionals by trimming a sheet of stiff paper cut from a supply roll thereof (not shown) to cover the window or windshield essentially entirely while leaving at least a portion of the external peripheral extent of the trim exposed. With the paper so trimmed, masking tape is applied about the periphery of the paper so as to overlap the trim 32 to the outer edge of the latter. Such conventional masking procedure is always tedious, as can be well imagined by the uninitiated and often necessitates the painter seeking additional help. The difficulties are especially pronounced in the case of large windows or where the masking requires labor to be performed from opposite sides of the vehicle, sometimes repetitiously as is often the case of windshields.

The mask 10 is specifically tailored to be used by professionals in shops having sufficient business that they will have rather frequent occasions to paint specific models of popular automobiles. Even though the shop may have to maintain a large inventory or stock of masks so as to be able to mask the particular windshields, rear and side windows of a variety of recent vintage popular automobiles, the savings in time and labor are such as to make such economically feasible. Fortunately, some masks are interchangeable so as to reduce the size of inventory. It is contemplated that the economies realizable may be sufficiently great that paint shop competitors pool their mask stock piles, or that a rental service might be established, particularly with respect to older automobiles having diminishing repainting needs.

Figure 2:
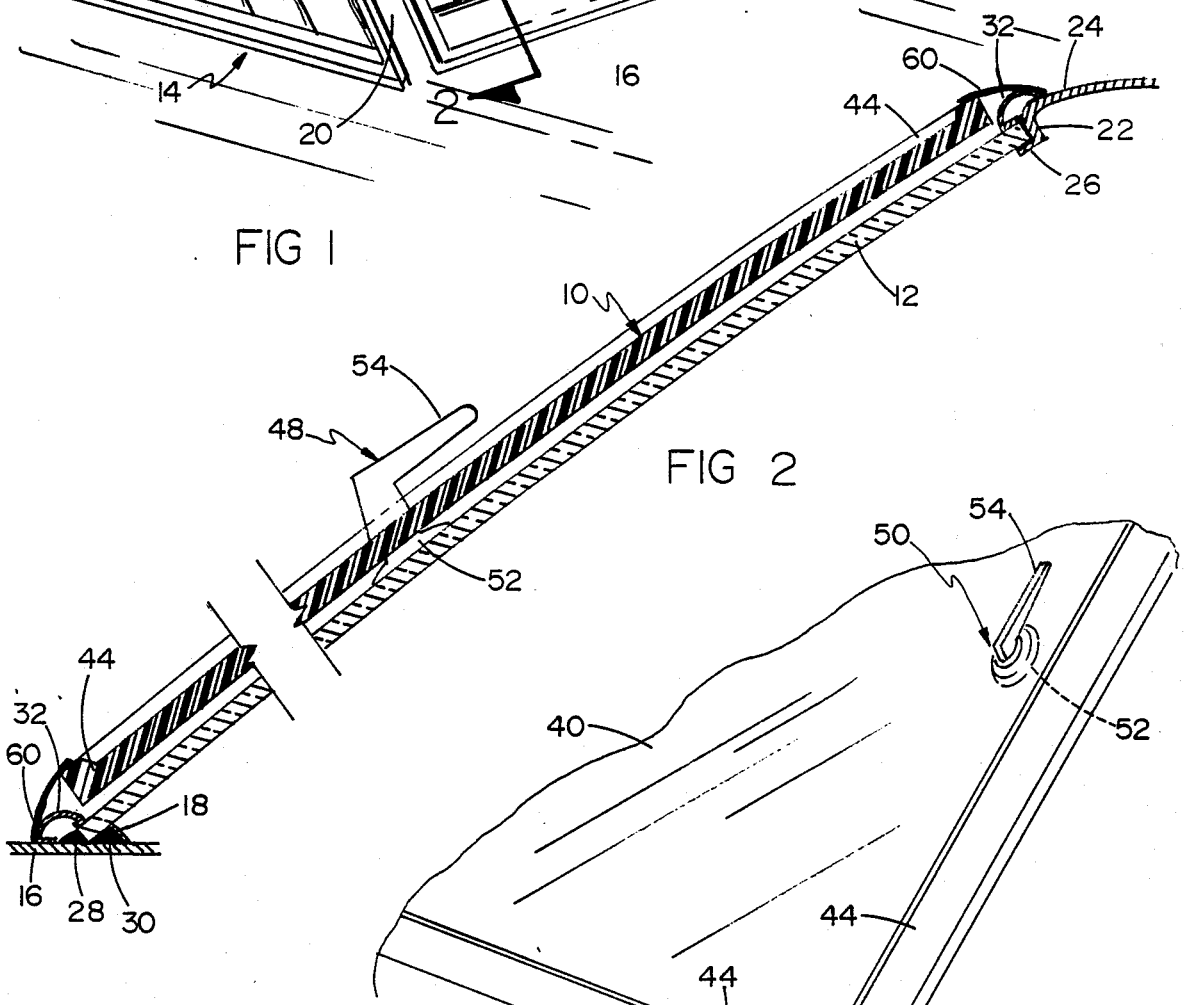
FIG. 2 is an enlarged and broken sectional view taken upon the plane of the section line 2—2 in FIG. 1.
Figure 3:
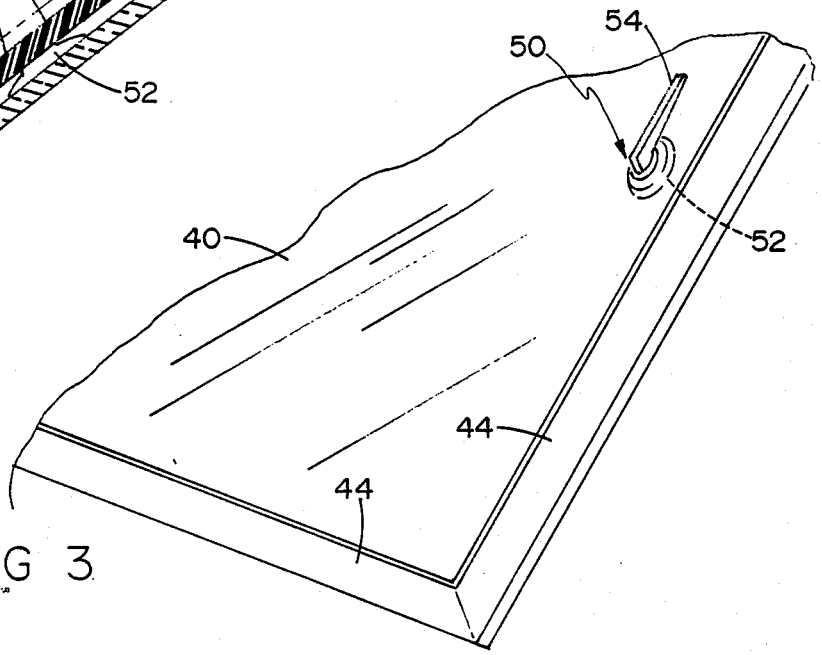
FIG. 3 is an enlarged and fragmentary view taken from the front of the lower right corner of the windshield as shown in FIG. 1 with the automobile and masking tape being deleted.

The illustrated mask 10 is specifically tailored for use with the windshield 12 of the automobile 14 and is comprised of a base plate or sheet 40 that is conformable in shape to the windshield 12 while being of less lateral extent than the windshield 12 as clearly shown in FIG. 2. Indeed, the lateral extent of base plate 40 is spaced inwardly a small and preferably uniform interval from the trim 32 when the mask 10 is oriented for use on the windshield 12 as shown in FIGS. 1 and 2.

The mask 10 does not have to have the rigidity of the windshield 12, but it is highly desirable if not actually necessary that the same be sufficiently stiff as to withstand handling without excessive bending or folding, and to be such as resiliently to conform or approach to configuration of the windshield 12 in repose. Such characteristics are attained by the base plate 40 being made of a suitable plastic or resin having resilient or shape memory characteristics. The desired mechanical properties of the mask 10 are further enhanced by the latter including an integral upstanding peripheral rib or flange 44 that serves two purposes, namely, reinforcement promoting rigidity, and as an elevated foundation surface for the application of masking tape as will be explained shortly.

The mask 10 is provided with means enabling ready manipulation by a sole worker, and for releasably securing the base plate 40 to the windshield 12. Such means comprises a pair of suction cup devices a pair of suction cup devices 48 and 50 that are spaced apart and which extend through the base plate 40 at positions spaced inwardly of the flanged or reinforced margins thereof.

Figure 5:
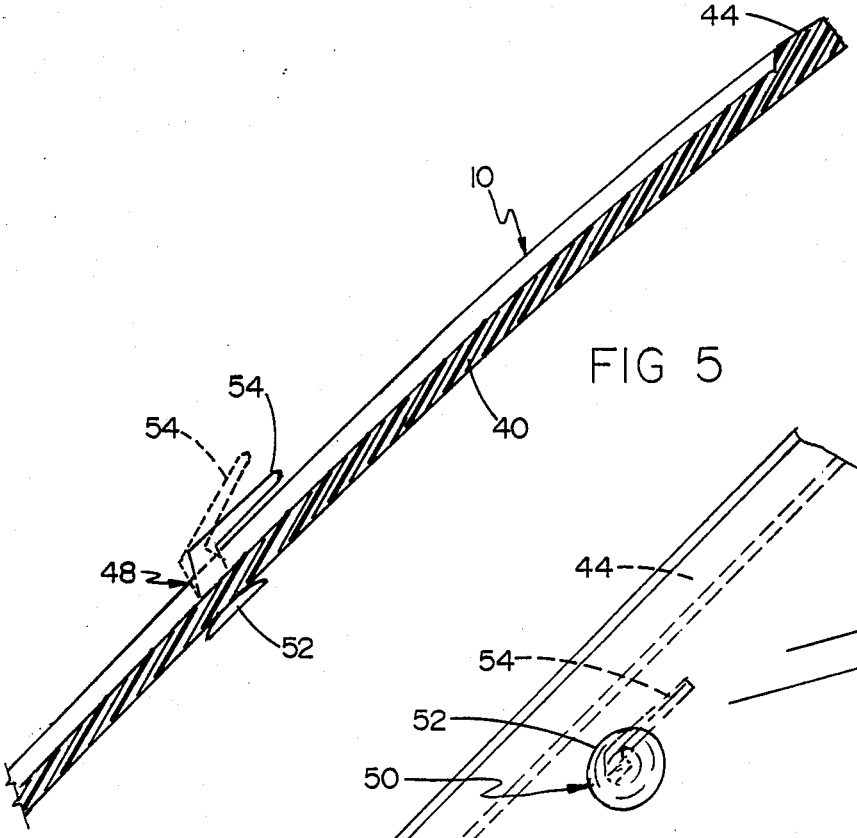
Figure 4:
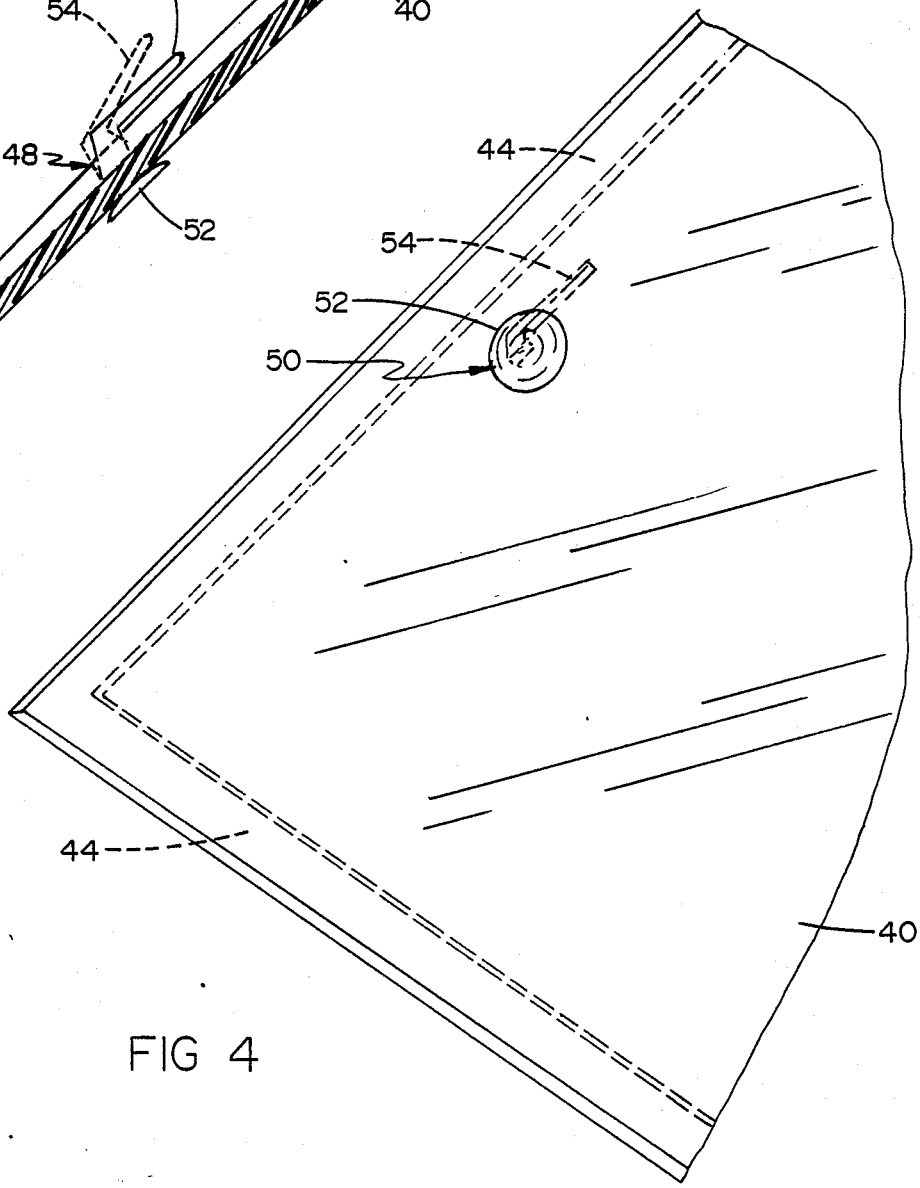
FIG. 4 is a view of the structure shown in FIG. 3 taken from the opposite direction; and, FIG. 5 is a fragmentary sectional view similar to FIG. 2 with the automobile and the masking tape deleted, and with the suction cup handle being shown in its release position in dashed outline.

The suction cup structures 49 and 50 are conventional and of the character of those employed by handlers of sheet glass, mirrors and the like where releasable purchase must be had on objects that present no convenient or hazard-free finger or hand grippable portions but rather only smooth planar or gently curved impervious surfaces. Such devices conventionally include a flexible suction cup 52 to which a manually rockable handle 54 is operatively connected. Those familiar with the art will recognize that when the handle 54 is rocked from the position shown thereof in dashed outline in FIG. 5 to its full line position the suction cup 52 is actuated to engage by suction any substantially flat and impervious surface in contact therewith. Conversely, rocking or pivotal movement of the handle 54 from its full line to dashed line position actuates the suction cup 52 to relieve suctional engagement.

The use of the mask 10 will be readily understood. Bearing in mind that the mask 10 is semi-rigid in the sense that while it may flex to some extent, it will not bend abruptly and is not foldable or rollable. It is sufficiently rigid and stiff that a user can pick up the mask 10 by the handles 54 of the units and extend the same over the windshield 12 while standing on one side of the automobile. The handles 54 can be in either their gripping or suction release positions during such operation.

With the mask 10 extending across the windshield 12 within the trim 32, the user then carefully orients the adjacent end of the mask 10 to be disposed within the trim and the adjacent suction cup into contact with the windshield whereupon the user then rocks the adjacent handle 54 to cause the adjacent suction cup 52 to suctionally engage the windshield 12. The user then does the same with respect to the other suction unit, and does so from the other side of the automobile 14 if more convenient, it being noted that with one suction cup engaged, the mask 10 will be sufficiently stable in its orientation to allow the user to move to the other side of the automobile.

After the mask 10 has been suctionally secured or engaged to the windshield, the user carefully applies masking tape 60 to cover the entire exposed extent of the trim 32 while overlapping the elevated or upper surface of the rib or flange 44. This results the entire surface of the windshield 12 and the trim 32 being shielded from any contact by paint which can then be conventionally applied by a paint spray gun, or by brush when desired. Spray painting can conventionally be effected if desired with employment of electrostatic techniques to attract charged paint particles to the surfaces being painted.

After painting has been effected and has dried, the masking tape 60 can then be readily removed, it being noted that the elevation of the rib 44 facilitates the user being able to achieve finger gripping of the masking tape 60 preparatory to breaking its weak adhesive bond to the trim 32 and the mask 10.

After removal of the masking tape 60, the user rocks the handles 54 to release suction engagement of the mask 10 with the windshield 12, whereupon the user can use the handles 54 to remove the mask 10 from the windshield 12 and place the mask 10 in a suitable storage place to await a need to paint another windshield complementary thereto, that is, a windshield of the size and contour to which the particular mask 10 is customized.

The mask 10 has been illustrated as being transparent or translucent, however, such is not necessary or essential, and indeed to maintain such characteristic would entail the user having to remove paint therefrom. Such removal, even if effected before the paint is dry, would ordinarily entail the use of a paint solvent. If such is to be the case, the selection of the material of which the mask 10 is fabricated should be based on a material compatable with the paint and the solvent.

As stated, the mask 10 can be opaque, however, transparency or being at least translucent can afford a measure of convenience to the user in his visually orienting or registering the mask with a windshield. Additionally, transparency enables a significant degree of visual communication between the interior and exterior of an automobile, and such can be useful when exterior painting and internal reconditioning (seat cover replacement, upholstery work, floor cover replacement, etc.) are being concurrently conducted.

While large side windows and especially rear windows may, like a windshield, make the provision of two suction units such as 48 and 50 highly preferable if not essential, it will be manifest that a single centralized suction unit may be more than adequate for masks tailored or custom made for small windows.

It is deemed manifest that those familiar with the art will be readily able to utilize such smaller masks in the light of the previously described use of the mask 10.

It is preferred that the base plate 40 have a thickness of from about 1/16 inch to 3/16 inch. Thicknesses outside such preferred range lack practical strength or are unwieldy. The rib or upstanding flange 44 that is monolithic with or fixedly secured to the base plate 40 has a height above the upper or outer surface of the latter that is preferably within the range of about 3/32 inch to about ¼ inch and preferably has a width of about ¼ inch to ¾ inch. The choice of dimensions for the rib 44 should be selected so as to obtain an adequate stiffness for the mask 10 such that the same will not fold or sharply bend, and to suit the user's preference as to the width most convenient for such user to attach and/or remove masking tape from the rib 44.

The base plate 40 and its integral flange 44 can be fabricated of a wide variety of plastics or synthetic resins. The material can be of either thermosetting or thermoplastic character though the latter is preferred for greater ease and/or economy of fabricating, as by vacuum forming or the like, the desired configuration.

While materials such as high density polyethylene, acrylate resins (particularly of methyl methacrylate) such as marketed under the trademarks LUCITE and PLEXIGLAS, and polyurethane are deemed especially well suited, the user may desire to consider as possibly suitable alternative materials such as nylon, vinyl products, polycarbonates, synthetic resin polymers based on acrylonitrile, styrene and the like.

With the invention now having been fully described, both as to its structure and use, attention is now directed to the appended claims for an appreciation of the actual scope of the invention.

I claim:

1. A spray painting accessory for preventing paint from contacting a vehicular window and trim peripherally bounding the latter, said accessory comprising a mask plate having a periphery and being of substantial spatial configuration integrity that is adapted to overlie an outer exposed vehicular window surface in a nearly coextensive fashion, said mask plate having inner and outer sides and including an integral relatively upstanding peripheral margin portion about its entire periphery serving to contribute to the spatial integrity of the mask and defining a surface for masking tape application thereto, with controllable suction cup means adapted for releasable attachment to a window being carried by and extending through the mask plate at a position spaced inwardly from the margin portion, said suction cup means including a suction cup on the inner side of the plate and a manually rockable suction cup control handle on the outside of the plate, the arrangement being such that a user can grasp the handle to support the mask plate while orienting the latter for use with respect to a vehicular window, and then manually rock the handle to actuate the suction cup for suction engagement with a window.

2. The combination of claim 1, wherein the mask plate is nonplanar, same being contoured and adapted to conform to a nonplanar window.

3. The combination of claim 1, wherein the mask plate is of a material sufficiently resilient to possess a predetermined shape memory in repose.

4. The combination of claim 3, wherein the material is a synthetic resin.

5. The combination of claim 1, wherein the mask plate is nonplanar, the same being contoured and adapted to conform to a nonplanar window, and wherein the mask plate carries a second suction cup means that is substantially spaced from the first recited suction cup means, whereby a user can use both hands to support and gain enhanced purchase on the mask plate when orienting the latter relative to a vehicular window.

6. The combination of claim 1, wherein the material of the mask plate is at least translucent.

7. A mask plate for use in combination with a vehicular window bounded by ornamental trim, wherein such window has an outer exposed surface of a particular contour and peripheral configuration, with the bounding trim having an exposed surface that is elevated along its bounding extent relative to adjacent peripheral portions of the exposed window surface, said mask plate having inner and outer sides and including an integral relatively upstanding marginal portion about its entire periphery having an elevated surface for reinforcement of spatial shape retention by the mask and for also providing an elevated surface adapted for the application of masking tape thereto and the trim, a spaced pair of controllable suction cup means secured thereto extending therethrough at positions spaced inwardly of the marginal portion, with each of said suction cup means including a suction cup on the inner side of the mask plate and a manually operable suction cup control and support handle disposed on the outer side of the mask plate with said handle being operatively connected to the suction cup to actuate and release suction action of the suction cup, the arrangement being such that the mask plate can be secured in close proximity to the exposed window surface by suction adherence of the suction cups to the window with the periphery of the plate being closely spaced within the trim.

8. The combination of claim 7, wherein the mask plate is of a synthetic resin.

9. The combination of claim 8, wherein the mask plate is at least translucent.

* * * * *